United States Patent [19]

Manderla

[11] 4,397,441

[45] Aug. 9, 1983

[54] WALL FORM AND METHOD OF ASSEMBLY THEREOF

[75] Inventor: Henry J. Manderla, Burlington, Canada

[73] Assignee: Anthes Equipment Ltd., Mississauga, Canada

[21] Appl. No.: 286,258

[22] Filed: Jul. 23, 1981

[51] Int. Cl.[3] ..... E04G 17/06

[52] U.S. Cl. ..... 249/19; 249/20; 249/33

[58] Field of Search ..... 249/33, 19, 20

[56] References Cited

U.S. PATENT DOCUMENTS

| | | | |
|---|---|---|---|
| 1,190,977 | 7/1916 | Bartow | 249/19 |
| 2,017,553 | 10/1935 | Troiel | 249/19 |
| 2,657,448 | 11/1953 | Faye | 249/20 |
| 3,632,079 | 1/1972 | Rohlf | 249/20 |
| 4,033,544 | 7/1977 | Johnston | 249/40 |
| 4,052,031 | 10/1977 | Melfi | 249/19 |
| 4,290,576 | 9/1981 | Schworer | 249/20 |

*Primary Examiner*—John A. Parrish

*Attorney, Agent, or Firm*—Hedman, Casella, Gibson, Costigan and Hoare

[57] ABSTRACT

The invention relates to an apparatus utilized in the pouring of concrete walls and includes a number of vertical girder-like or "strong-back" members to which are clamped a number of transversely extending beam members having wooden inserts to which plywood panels are nailed, the arrangement constituting a form. In use, a pair of such forms are spaced apart by tie rods extending from one form to the other form and concrete is poured between the facing plywood panels. Selected of the strong-back members may be provided with brackets which assist in ensuring that the form is in correct vertical alignment to the ground and other brackets may be provided to cooperate with the strong-back members in order to support a walkway and a safety-fence.

7 Claims, 4 Drawing Figures

WALL FORM AND METHOD OF ASSEMBLY THEREOF

This invention relates to forms suitable for use in the pouring of concrete walls. Such forms, ganged together, are well known in the building industry and are usually composed of many integers which must be bolted together to serve as supports for the plywood panels between which the liquid concrete is poured. The measure of efficiency and the basis of labour costs when considering the use of such forms can be expressed in square feet of form contact area per manhour and this expression is applicable both to what is known as job-built formwork as well as to the unitary method of formwork, the latter being infinitely superior to the former because of the reduction in labour involved and because such forms can be re-used for more times than job-built formwork. Hence, unitary forms present a significant saving in both labour and material costs.

One type of unitary form, and the assembly thereof, includes the initial placement on a jig of complementary pairs of first profiled structural members in spaced parallel relationship to one another and each having a pair of complementary T-shaped slots. One of the slots is provided with a lumber insert and this end of each structural member is placed face down on the jig. T-bolts, cooperating with clamp members, are then slidden into the T-shaped slots in the upper ends of the structural members.

Strongback members must then be assembled by placing complementary pairs of parallel second structural members on the first members so as to extend normal thereto, each said second member being provided with a pair of complementary spaced T-shaped slots adapted to receive additional T-bolts therein. Tie-plates each provided with spaced U-shaped slots and a central hole, are then placed on the second structural members and the said additional T-bolts inserted in said slots and tightened. Hence, the tie-plates secure each pair of second structural members in spaced relation to form a strongback. The clamp members are then positioned so that they will clamp the strongbacks to the first structural members, and the first-mentioned T-bolts are then tightened. The assembled unit is then raised and turned over so that the lumber inserts face upwardly to receive plywood panels which are then nailed to the inserts. The holes in the tie-plates are then located and corresponding holes are then drilled in said panels. The unit is then framed in lumber and is then lifted into its service position ready to receive additional accessories such as walkways etc.

Assembling such a form is extremely time-consuming and the amount of integers required to construct the form naturally requires an extremely large stock of items to be maintained. Hence, it is the object of the present invention to provide a form, and a method of assembly, which is much simpler than hitherto known unitary structures whereby the number of required integers and the amount of assembly time is drastically reduced.

The invention is illustrated, by way of example, in the accompanying drawings in which.

Figure 1:
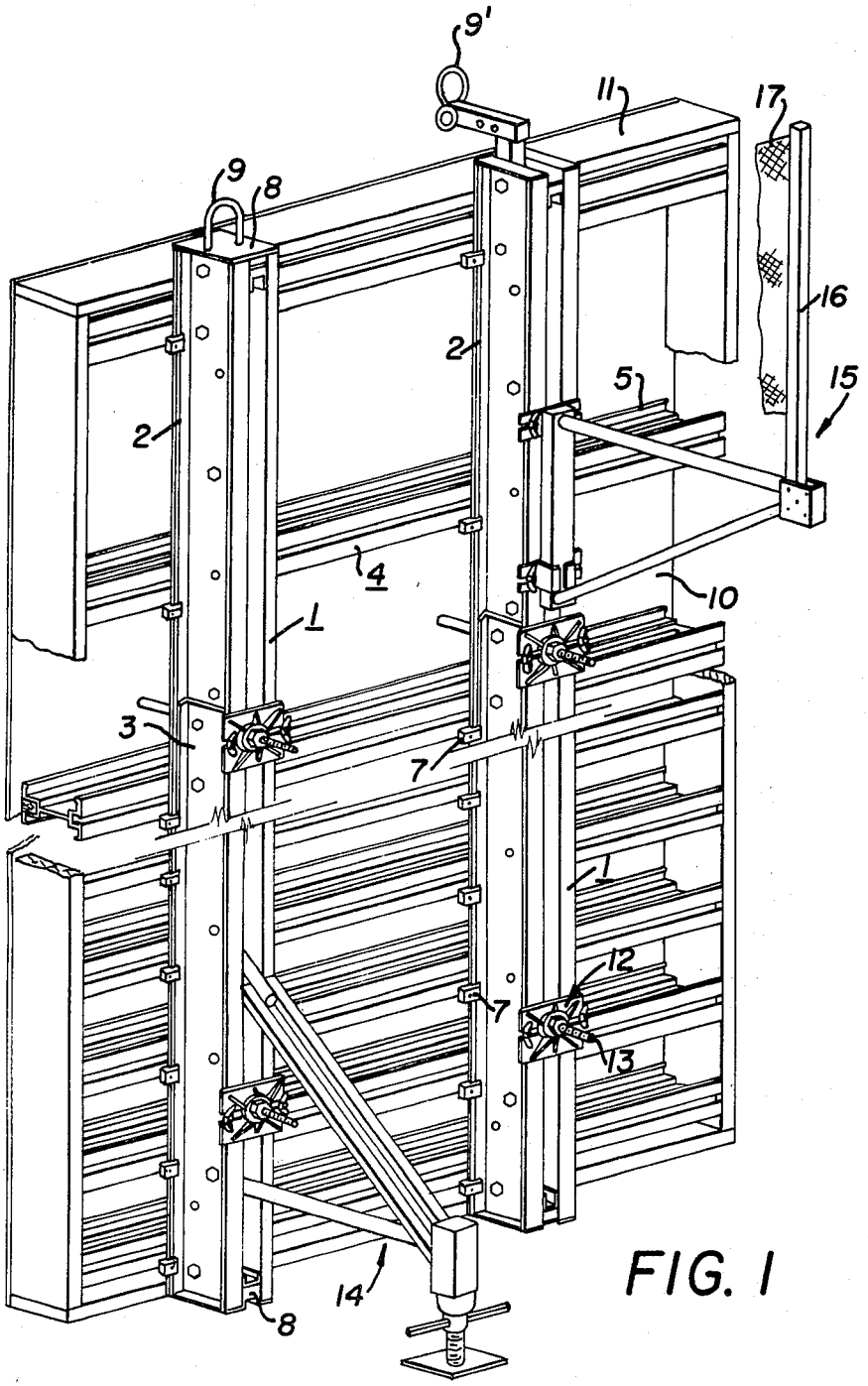
FIG. 1 is a diagrammatic perspective view of the form.

Referring to the drawings, a form (which can either be assembled on site or at the plant) utilized in the pouring of concrete walls includes a plurality of spaced parallel profiled strongback members indicated generally at 1 which are preferably of the type described and claimed in copending application Ser. No. 286,911 filed July 23, 1981 and which have stub flanges 2 of substantially conical cross-section. It will be appreciated that, if desired, connector plates 3, located either side of a pair of strongbacks, will connect the latter in end-to-end relation. The ends of the strongback members can, if desired, be fitted with shoes 8 which, if required, can be fitted with a lifting eye such as those indicated at 9,9'. The shoes effectively close the open ends of the members 1 to inhibit the entry of foreign matter therein and damage to the ends of the strongbacks.

Figure 2:
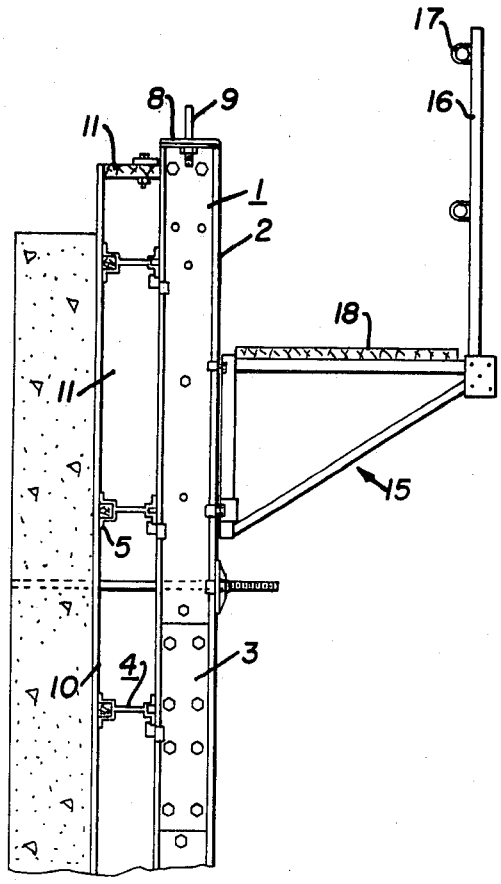
FIG. 2 is a side view of FIG. 1.
Figure 2:
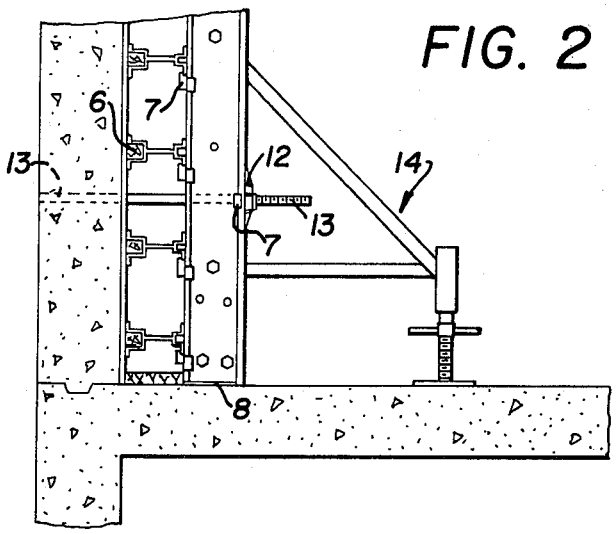

The strongbacks 1 are then preferably placed on a jig in spaced parallel formation and, thereafter, a plurality of spaced parallel structural members, indicated generally at 4, having stub flanges 5 of substantially conical cross-section and lumber inserts 6 (see FIG. 2) are then placed on said strongbacks so as to extend normal thereto and whereby said inserts face upwardly. Preferably, the structural members are of the types described and claimed in copending application Ser. No. 286,294 filed July 23, 1981. Profiled clamp members, indicated generally at 7 and having grooves complementing the stub flanges are adapted detachably to clamp the strongback members 1 to the structural members 4, said clamps 7 preferably being of the type described and claimed in copending application Ser. No. 286,089 filed July 23, 1981.

Plywood sheets 10 are then placed on the structural members 4 and nailed to the inserts 6. Holes (not shown) are then drilled in said plywood-facing which is surrounded by a lumber frame 11.

A crane (not shown) through the intermediary of the lifting eyes 9 or 9' then raises the form (constructed thus far) to the vertical.

A plurality of slotted and bored tie-plates, indicated generally at 12, and preferably of the type forming the subject of application Ser. No. 286,295 filed July 23, 1981 are then detachably secured to the flanges of the strongback members 1 by means of said clamps 7 engaging said slots. Each tie-plate 12 has a cooperating threaded tie-bolt 13 which passes between the cheek members of the strongback members 1 and through the holes in the plywood 10 so as to extend therefrom.

While the form is hanging in the vertical, adjustable plumbing and support frames, indicated generally at 14 are connected to certain of the strongback members 1 adjacent their lower ends and walk-way brackets (indicated generally at 15 and which may also be adjustable) are connected to certain of the strongback members adjacent their upper ends, by means of the aforesaid clamps 7, which clamp the brackets 15 to the stub flanges 2 of said strongback members 1. The walk-way brackets 15 have upright post members 16 detachably secured thereto which serve to support a safety fence 17. The brackets also serve to support a walk-way 18.

When a pair of complementary forms have been erected vertically, so that the tie-bolts 13 maintain said pair of forms in spaced relation, concrete is then poured between the space existing between the facing plywood sheets 10 to form a poured concrete wall W. After the latter has set, and if it is desired to increase the height of the wall by further pouring, the forms are then raised vertically by a crane, leaving the tie-bolts 13 behind. Additional strongback members 1' are then connected to the lower ends of the members 1 of the form by means of connector plates 3 as is shown in FIG. 3.

Figure 3:
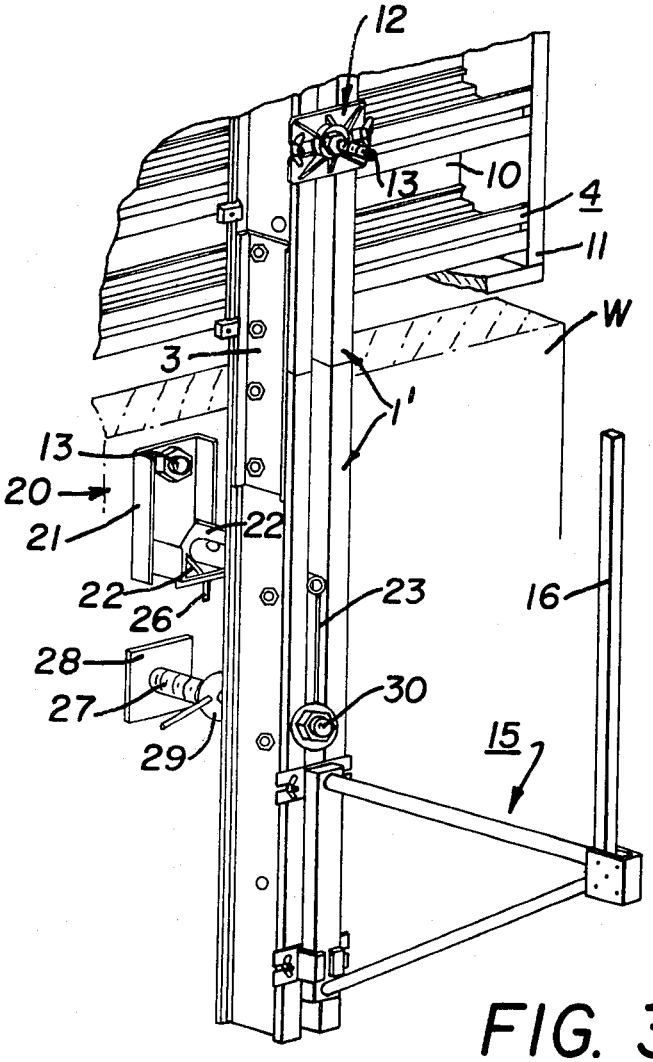
FIG. 3 is a detail view.
Figure 4:
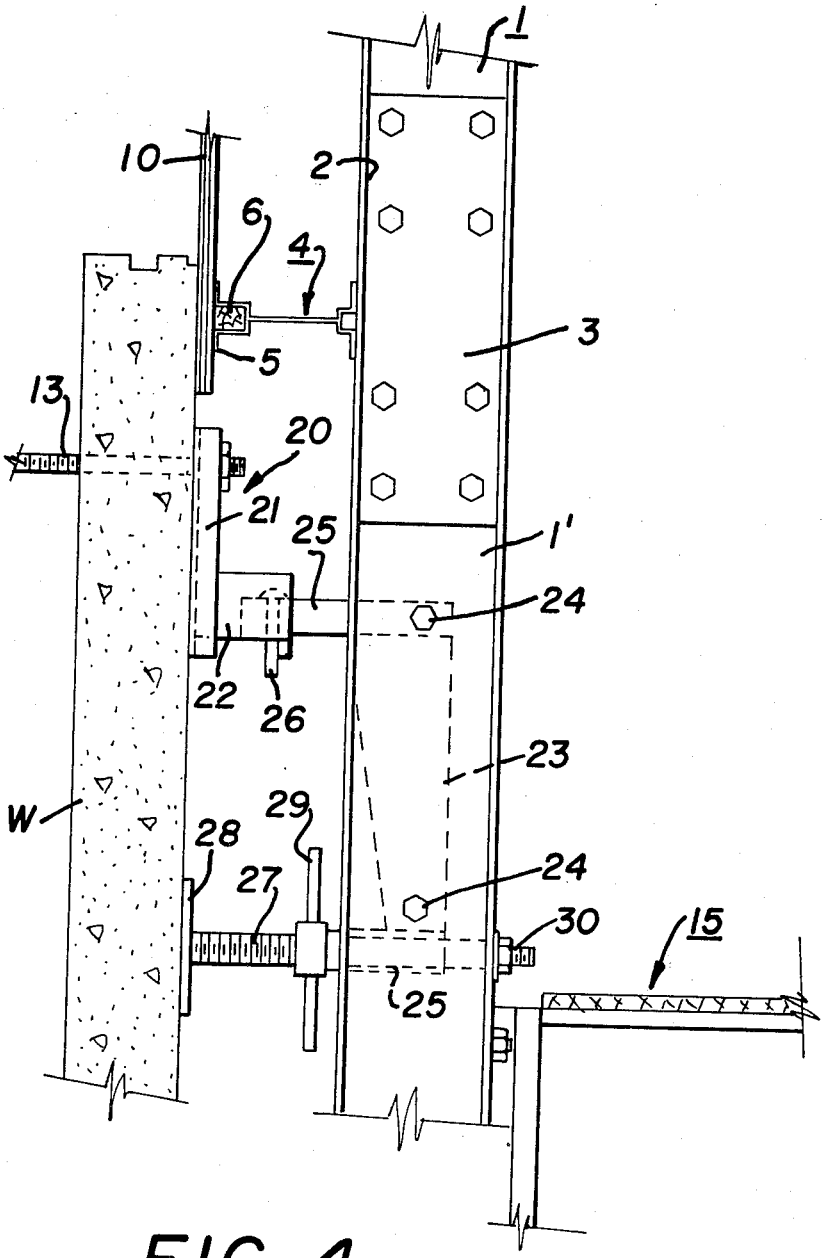
FIG. 4 is a side view of FIG. 3.

A combined climbing and plumbing bracket, indicated generally at 20 in FIGS. 3 and 4, is detachably secured to the outer end of a tie bolt 13 adjacent the top of the poured and set wall section. The bracket 20, has a pair of side flanges 21 and a pair of inwardly converging cheeks 22 located adjacent the lower end of the said bracket with a closed slot (not shown) in said lower end and between the cheeks 22.

A locking pin holder, indicated generally at 23 is detachably secured within a lower strongback member 1' by bolts 24 and cooperating nuts. The upper and lower ends of said holder are constituted by a pair of tubes 25, the outer end of the upper tube 25 being provided with a depending locking pin 26. The lower tube 25 is adapted to receive a threaded screwjack 27 provided at its outer end with a fixed base-plate 28 which is adapted to be placed in face-to-face contact with the face of the poured and set section of the wall. The jack 27 is provided with a cooperating adjustment nut 29 and a nut 30 at its other end to retain it within the lower tube 25.

Accordingly, once the additional strongbacks 1' have been secured to the lower ends of strongbacks 1 and the climbing brackets 20, holders 23 and jacks 27 have been placed in position, the crane will then guide the assembled form whereby the lower end of the first form will be in face-to-face contact with the upper portion of the first poured and set section of the wall. As the assembled form is lowered into this position, the cheeks 22 of the climbing bracket 20 serve to guide the locking pin 26 into the slot in the lower end of said bracket thereby retaining the assembled form in juxtaposition with the poured and set section of the wall. Thereafter, and to adjust the vertical alignment of the assembled form in relation to the poured and set section of the wall, it is merely necessary to adjust nut 29 on the screwjack 27 either towards or away from said wall thereby adjusting the vertical inclination of strongbacks 1' and, hence, strongbacks 1.

I claim:

1. A form utilized in the pouring of concrete walls, said form including:

(a) a plurality of spaced parallel profiled primary strongback members, each said strongback member including an elongated web having opposed upper and lower longitudinal edges, a pair of lower flanges connected to and extending from the lower longitudinal edge of said web, an upwardly extending stub flange connected to the edge of each said lower flange most distant from said web, a pair of upper flanges connected to and extending from the upper edge of said web, and a downwardly extending stub flange connected to the edge of each said upper flange most distant from said web;

(b) a plurality of spaced parallel profiled structural members, each said structural member including an elongated web having upper and lower longitudinal edges, a pair of lower flanges connected to the lower longitudinal edge of said web and being configured to accept a lumber insert therebetween, a pair of upper flanges connected to and extending from the upper edge of said web, at least one downwardly extending stub flange connected to the edge of one said lower flange most distant from said web, and a lumber insert disposed intermediate the lower flanges of said structural member;

(c) a plurality of clamp members detachably engageable with said stub flanges of adjacent strongback lower flanges and structural member upper flanges to maintain said strongback and structural members normal to one another;

(d) a plurality of plywood panels detachably secured to said lumber inserts; and (e) a plurality of tie plates and cooperating tie bolts detachably secured to the stub flanges of the upper flanges on said strongback members, said tie bolts extending through said plywood panels;

said form being capable of connection to, but spaced from, a complementary form whereby each said form can be efficiently assembled so that concrete can be poured between the pair of forms to produce a poured concrete wall.

2. Apparatus according to claim 1 including combined plumbing and support means detachably secured to selected ones of said strongback members.

3. Apparatus according to claim 2 including bracket means detachably secured to the stub flanges of certain of said strongback members and adapted to support a walk-way.

4. Apparatus according to claim 3 wherein said bracket means has upright post members detachably secured thereto and serving to support a safety fence extending therebetween.

5. Apparatus according to claim 4 wherein additional strongback members are detachably secured to one end of each of selected ones of said primary strongback members.

6. Apparatus according to claim 5 including brackets detachably secured within said additional strongback members and having projecting means adapted to cooperate and interlock with detents projecting from the previously poured and set section of a concrete wall whereby the form can be positioned in vertical operative alignment with said section, said brackets also having screw means adapted to vary the vertical alignment of the form in relation to said previously poured section and prior to the pouring of the next succeeding section.

7. Apparatus according to claim 6 including closure members detachably secured to each of said primary strongback members, certain of said closure members being provided with means whereby said form can be raised and lowered.

* * * * *